US007387433B2

(12) United States Patent
Hung

(10) Patent No.: US 7,387,433 B2
(45) Date of Patent: Jun. 17, 2008

(54) INTEGRATED CIRCUIT CHIP FOR ANALOGUE ELECTRONIC WATCH APPLICATIONS

(75) Inventor: Patrick Siu-Ying Hung, Saratoga, CA (US)

(73) Assignee: Linx Technology Limited, Hong Kong Sar (CN)

( * ) Notice: Subject to any disclaimer, the term of this patent is extended or adjusted under 35 U.S.C. 154(b) by 105 days.

(21) Appl. No.: 11/360,500

(22) Filed: Feb. 24, 2006

(65) Prior Publication Data

US 2006/0203618 A1 Sep. 14, 2006

(30) Foreign Application Priority Data

Feb. 5, 2005 (CN) ..... 05101601

(51) Int. Cl.
*G04B 17/12* (2006.01)

(52) U.S. Cl. ..... 368/299; 368/201

(58) Field of Classification Search ..... 368/299, 368/201, 157, 202

See application file for complete search history.

(56) References Cited

U.S. PATENT DOCUMENTS 3,812,699 A * 5/1974 Koost et al. ..... 72/76
3,949,545 A * 4/1976 Chihara ..... 368/66
3,998,044 A * 12/1976 Yamauchi et al. ..... 368/80
4,198,809 A * 4/1980 Miyasaka et al. ..... 368/80
4,259,736 A * 3/1981 Berney ..... 368/62
4,465,378 A * 8/1984 Maurer et al. ..... 368/88
4,763,309 A * 8/1988 Descombes ..... 368/201
2006/0203618 A1* 9/2006 Hung ..... 368/200

* cited by examiner

*Primary Examiner*—Gary F. Paumen
(74) *Attorney, Agent, or Firm*—Buchanan Ingersoll & Rooney PC

(57) ABSTRACT

An integrated circuit for analogue electronic watch applications, comprising an oscillator circuit for generating clock signals, stepper motor driver circuit for generating motor driving signals, a plurality of trimming capacitors for fine-tuning the output frequency of the oscillator circuit and a corresponding plurality of electronic switches for selectively connecting/disconnecting said trimming capacitors to said oscillator circuit and switching circuitry for switching-in and/or -out the electronic switch, wherein said stepper motor driver circuit being connected to said oscillator circuit and comprising means for converting said clock signals into said motor driving signals, said switching circuitry comprises means to control the switching-in and/or switching-out of said electronic switches whereby oscillator frequency is fine-tuned, said plurality of electronic switches being selectively controllable and operable by switching control signals applied at said frequency trimming port.

15 Claims, 8 Drawing Sheets

| 1st Sample | 2nd Sample | TRIM Configuration | Freq Compensation |
|---|---|---|---|
| Low | Low | TRIM – VSS / Open | Nominal Frequency |
| High | Low | TRIM – MOT-1 | - 6ppm |
| Low | High | TRIM – MOT-2 | - 12ppm |
| High | High | TRIM – VDD | - 18ppm |

INTEGRATED CIRCUIT CHIP FOR ANALOGUE ELECTRONIC WATCH APPLICATIONS

FIELD OF THE INVENTION

This invention relates to integrated circuits for analogue electronic watch applications and, more particularly, to integrated circuit chips for analogue electronic quartz watches and analogue electronic quartz watches incorporating such chips.

BACKGROUND OF THE INVENTION

Electronic watches typically comprise quartz oscillators for generating timing signals. Quartz electronic watches are popular because they are reasonably accurate at reasonably low costs. Among the various types of quartz electronic watches, analogue-type electronic watches comprising hour, minute and/or second arms resembling that of a traditional watch are an important variety.

Electronic watches, whether digital or analogue, are typically built around a quartz oscillator circuitry which generates a timing oscillation. This timing oscillation produces a fundamental timing frequency in the form of pulses which are also commonly referred to as "clock signals". An exemplary timing oscillation suitable for electronic watch applications is at 32.768 kHz. In case of an analogue electronic watch, the timing oscillation is converted into pulses for driving a stepper motor by a stepper motor driver circuit. The stepper motor in turn drives the time indicating arms. Typically, the motor driving pulses have a period of either 1 second or 60 seconds so that the second or the minute arm will move by 1 graduation at the intervals of a second or a minute respectively. The oscillator circuitry and the stepper motor driver circuit are usually integrated on a single integrated circuit (IC) chip for a compact, slim design and/or for costs saving.

FIG. 1 shows an exemplary quartz oscillator circuit which is more commonly known as the CMOS Pierce oscillator circuit. The Pierce oscillator circuit is widely used for timing signal generation in a digital electronic timing circuit and includes quartz crystal operating in the parallel mode.

To maintain a reasonable timing accuracy for timing integrity, the oscillation frequency of an oscillator circuit should be sufficiently accurate. For example, in a digital watch, an error of 20 ppm (parts per million) will result in a timing deviation of approximately 1 minute per month. In general, the accuracy of a crystal-based oscillator circuit depends mainly on the accuracy of the crystal and the capacitive load. For example, the oscillation frequency will increase if the capacitive load is decreased. Conversely, the oscillation frequency will decrease with an increase in the capacitive load.

Quartz crystals are commercially available as discrete components with a specified typical characteristic oscillation frequency when connected with a parallel capacitive load of a predetermined specific load capacitance. For electronic watch applications, a discrete quartz crystal is typically connected to an integrated watch circuit for forming a timing oscillator.

In an exemplary equivalent circuit of a typical oscillator shown in FIG. 2, the components $C_O$, $C_1$, $L_1$ and $R_1$, are the typical characteristic inherent parameters of a quartz crystal. The ratio of $C_O$ to $C_1$, is a parameter representative of the inter-conversion between electrical and mechanical energy stored in the crystal. The component $C_L$ is equivalent to the two on-chip load capacitance measured in series. To generate an accurate oscillator operating frequency, the crystal parameters $C_O$, $C_1$, $L_1$, $R_1$ and the load capacitance $C_L$ have to be properly matched, for example, by on-chip fine-tuning capacitors.

However, on-chip capacitors for digital watch applications usually have a manufacturing tolerance of approximately 10% to 20%. To alleviate timing inaccuracy due to such tolerance in a typical digital watch production line, quartz crystals and silicon integrated chips are usually sorted individually for optimal matching. Such a process is typically manual, slow and expensive. Furthermore, for quartz crystals and silicon chips that cannot be matched, they have to be thrown away, thereby adversely affecting the overall production yield and increasing the overall production costs. On the other hand, it is well-known that on-chip capacitors and quartz crystals are very expensive and difficult to manufacture with very high precision.

Hence, it will be desirable if integrated circuit-chips for watch applications comprising means to fine-tune the oscillation frequency of the quartz oscillator circuitry can be provided in order to enhance timing accuracy without requiring unduly complicated or expensive circuitry or designs. Furthermore, it will be appreciated that external connection pins or pads on an integrated circuit chip are a valuable resource since additional pins or pads beyond an optimum number will mean increased package and production costs. Hence, it will be desirable if multiple-step fine-tuning can be achieved with minimum number of interfacing pad/pin. This is even better if no additional external logic circuitry and pinning requirements and/or with pinning configuration is required so that the integrated circuit is compatible with conventional watch IC layout for direct replacement so that manufacturing costs can be optimised and costs for PCB or tooling re-design can also be saved.

OBJECT OF THE INVENTION

Accordingly, it is an object of the present invention to provide an integrated circuit for watch applications with an oscillator tunable by a plurality of trimming capacitors which are controllable through a single port so that the pads can be optimally used. At a minimum, it is an object of this invention to provide a useful choice of an integrated circuit for the public.

SUMMARY OF THE INVENTION

According to the present invention, there is provided an integrated circuit for analogue electronic watch applications, comprising an oscillator circuit for generating clock signals, stepper motor driver circuit for generating motor driving signals, a plurality of trimming capacitors for fine-tuning the output frequency of the oscillator circuit and a corresponding plurality of electronic switches for selectively connecting/disconnecting said trimming capacitors to said oscillator circuit and switching circuitry for switching-in and/or -out the electronic switch, wherein said stepper motor driver circuit being connected to said oscillator circuit and comprising means for converting said clock signals into said motor driving signals, said switching circuitry comprises means to control the switching-in and/or switching-out of said electronic switches whereby oscillator frequency is fine-tuned, said plurality of electronic switches being selectively controllable and operable by switching control signals applied at said frequency trimming port.

According to another aspect of this invention, there is provided an integrated circuit for analogue electronic watch application, comprising an oscillator circuit for generating clock signals, stepper motor driver circuit for generating motor driving signals, a test circuit for testing stepper motor, a reset circuit for stopping and starting said oscillator circuit, and one or two on-chip trimming capacitors, wherein said trimming capacitors are located in the external pads of said test and reset circuits, and oscillator frequency can be adjusted by connecting either oscillator input or output pad with test pad, reset pad, or both.

Preferably, said switching circuitry comprises a switching control signal discriminator which detects and discerns the switching control signals at said frequency trimming port and said switching control signal discriminator causes said switching circuitry to selectively operate said plurality of electronic switches according to the individual characteristics of said switching control signals whereby the oscillation frequency of said oscillator can be varied by one of a plurality of discrete steps.

Preferably, each trimming capacitor and each electronic switch being connected in series, each serial combination of a trimming capacitor and an electronic switch being in parallel to the connection of a quartz crystal during operation.

Preferably, said switching circuitry comprises a tri-state switch, said integrated circuit comprises three electronic switches and three trimming capacitors, the external switching state signal comprises said motor driving signals.

Preferably, operation of said plurality of electronic switches to connect and/or disconnect the trimming capacitors to the oscillator circuit is by a switching state signal sent via a single external connection pad on said integrated circuit.

Preferably, said control signals comprise pulses from said motor driving circuitry.

Preferably, said oscillator circuitry having a characteristic frequency of 32.768 kHz, the output frequency of the stepper motor driver during normal operation as an analogue watch being 1 Hz.

Preferably, said integrated circuit chip having a total of 8 externally accessible contact pads.

Preferably, said switching control signal comprises one of the following alternatives, supply voltage to the integrated circuit, floating open of the frequency trimming port, tying of the frequency trimming port to the ground, the motor driving signals and/or a combination thereof.

Preferably, said stepper motor driver circuit comprises two output ports for generating two streams of motor driving signals with different pulse timing, the switching control signal discriminator is adapted to receive and discern the two streams of motor driving signals whereby said plurality of electronic switches are operated to produce at least two frequency trimming capacitance according to which one of the streams being connected to frequency trimming port.

Preferably, the two streams of motor driving signals have the same pulse period and frequency but with different pulse rising timing.

Preferably, said control signal discriminator comprise timing means to discriminate the two motor driving signals with reference to the timing relationship between the two motor driving signal streams.

Preferably, the switching states of the plurality of electronic switches are established during starting-up of the integrated circuit, the switching control signal discriminator comprises means to ascertain whether the switching control signal is one of the two motor driving signals by referencing to the pulse-timing of the two motor driving signals.

Preferably, pulse-timing of at least one of the motor driving signals is used to operate at least one of the plurality of the electronic switches, whereby the load capacitance of the oscillator circuit is varied.

BRIEF DESCRIPTION OF THE DRAWINGS

Preferred embodiments of the present invention will be explained in further detail below by way of example and with reference to the accompanying drawings, in which.

DETAILED DESCRIPTION OF THE PREFERRED EMBODIMENTS

Figure 1:
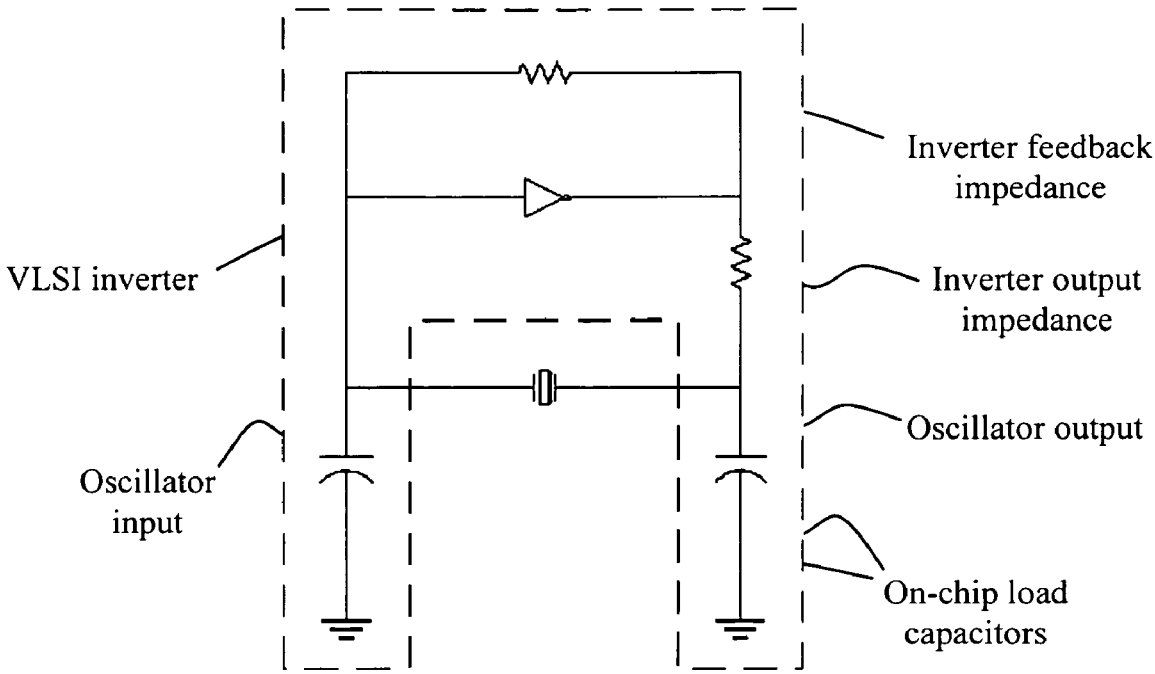
FIG. 1 shows the circuit of a Pierce oscillator as an example of a commonly used quartz oscillator circuit.
Figure 2:
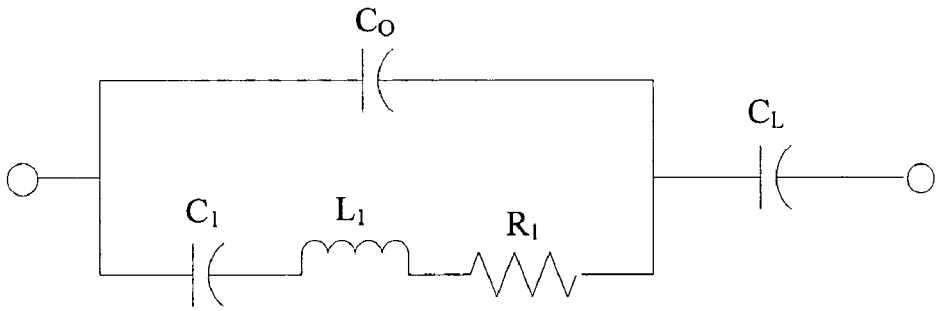
FIG. 2 shows an effective equivalent circuit of the oscillator circuitry of FIG. 1.

A typical integrated circuit for analogue electronic quartz watch applications usually comprises an oscillator circuit for connection with an external quartz crystal as shown in FIGS. 1 and 2. It is well known to persons skilled in the art that on-chip capacitors and quartz crystals with a very high precision are very expensive. In order to correct the frequency deviation of quartz oscillators due to, for example, manufacturing tolerances of the on-chip capacitors and the quartz crystals, fine-tuning capacitors can be used so that the effective value of the load capacitors $C_L$ can be fine-tuned. Since the necessary value of a fine-tuning capacitor $C_d$ in the case of watch applications is typically in the picofarad (pF) capacitance region, it is desirable to have the fine-tuning capacitor on-chip. This is particularly so in view of the increasing miniaturization of electronic watches.

On the other hand, due to chip size limitation, the number of on-chip contact pads is practically limited. Any additional contact pads to be added will mean increased chip size, chip costs and production costs. Hence, using multiple on-chip load capacitors to fine-tune the oscillation frequency can be undesirable in many applications because the multiple-on-chip-capacitor approach typically requires either additional contact pads or incompatible circuit design. For example, a typical conventional integrated chip for quartz watch applications has 8 contact pads for making external connection, namely, two for connection to an external quartz crystal, two for stepper motor driver output, two for power supply, one for stepper motor test and one for reset. It will be appreciated if a watch IC with fine-tuning capacitors can be provided with the same contact pad configuration or layout to enhance practical and commercial values.

Figure 3:
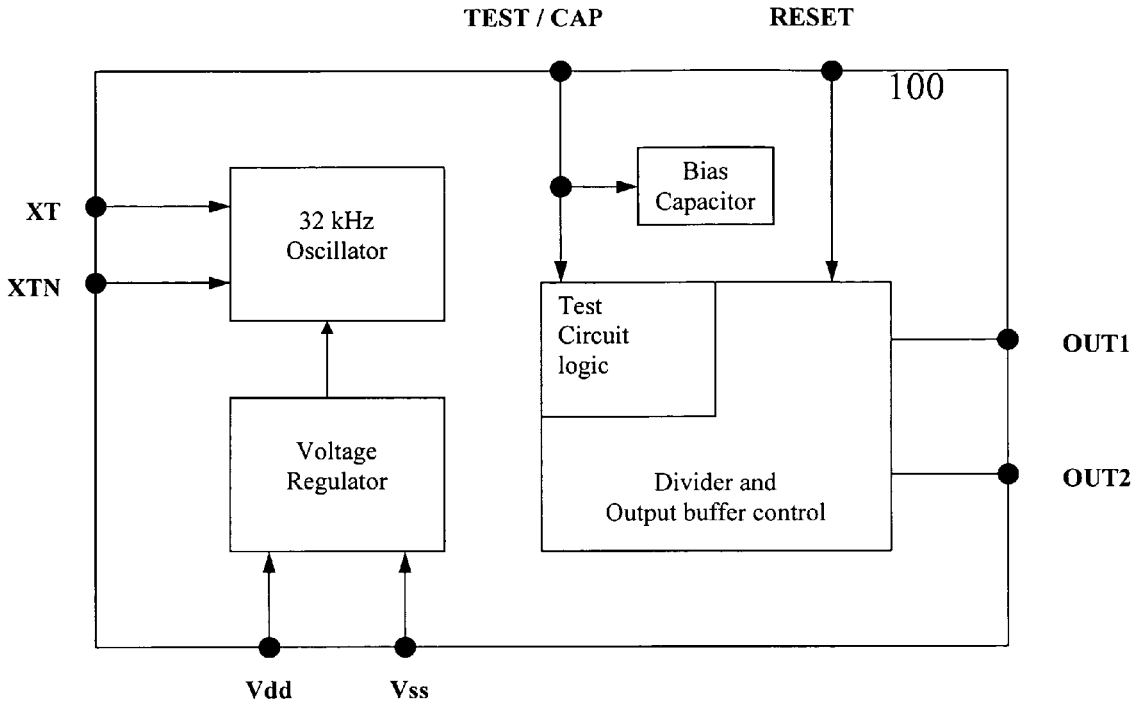
FIG. 3 is a schematic functional block diagram of a preferred embodiment of an integrated circuit of the present invention.

An exemplary integrated circuit chip (100) of a first preferred embodiment of the present invention shown in FIG. 3 comprises a 32.768 kHz oscillator circuitry, a voltage regulator, a digital circuitry comprising a divider, output buffer control or other logic or control circuitry as well as test circuit logic, and a fine-tuning capacitor. The integrated circuit chip has a total of 8 contact pads similar to conventional or typical integrated circuits for analogue electronic watch applications. The contact pads including first and second contact pads for connection between the quartz crystal and the oscillation circuitry, third and fourth contact pads respectively for the positive and negative supply voltage, fifth and sixth contact pads for stepper motor driver output, a seventh contact pad for reset switch and an eighth contact pad for stepper motor test. Unlike conventional analogue watch integrated circuits, the "stepper motor test" contact pad may also be used for fine-tuning the oscillation frequency, as described later in this specification.

The oscillator circuitry can be a conventional Pierce oscillator circuit or other appropriate oscillator circuitry. The voltage regulator generally provides a stable operating power for operation of the electronic watch. The stepper motor driver circuit including means to convert the 32.768 kHz timing signal from the oscillator into driving signals suitable for operating the analogue time indicating means, such as the minute or second arm of an analogue electronic watch. For example, the output frequency from the stepper motor control can be at 1 Hz for an analogue electronic watch with a "second" arm. Similarly, for a watch with a "minute" arm, the stepper motor driver can output a pulse at a frequency of 1/60 Hz.

The reset circuitry is typically provided to stop the watch for a number of reasons. For example, it is necessary to stop the watch during shipment to conserve battery energy. In a typical reset circuitry, a reset operation occurs when the "reset" contact pad is held HIGH at $V_{DD}$ (the positive supply voltage) for say, 100 ms to activate reset. When the reset pulse is activated, the frequency dividers in the stepper motor control circuitry will be stopped. After the reset switch has been released, the stepper motor driver output will output driving pulses again.

The "test" circuitry is provided for testing of the stepper motor of an analogue electronic watch at an elevated speed. For example, when the "test" contact pad is held HIGH for a prescribed minimum clock cycles, a test signal of 512 Hz or other appropriate frequency or format will be output to the stepper motor output so that the stepper motor of the watch will be driven at that speed. In some integrated circuits, there may be an additional or alternative test connection which will perform, for example, testing at 32-time speed when the test contact pad is tied to a logic low level.

For conventional integrated circuits, the test contact pad will remain open circuited or unconnected after production or during normal watch operation. By sharing this contact pad with the free end of the fine-tuning capacitor, the scarce resource of contact pads can be optimally utilised, thereby alleviating the need of an additional contact pad. This contact pad sharing is advantageous since the test circuit will only be used once during watch production and it will be a waste if a dedicated contact pad is provided solely for that purpose. In a conventional analogue watch integrated circuit, it is not feasible to externally connect the test contact pad with the oscillator contact pads because the oscillator signals can adversely affect the test circuit, thereby triggering or disabling the test function. Similarly, an external "high" test signal may also stop the oscillator circuit, thereby indirectly disabling the test function. To counter the effects of the oscillator signals on the test circuit, a digital filter is added to the test circuit whereby high-frequency signals are removed. To counter the effects of an external test signal on the oscillator circuit, a backup on-chip oscillator is used in test mode. This backup oscillator does not need to be accurate (e.g. a tolerance of +/−30% is allowed) and can easily be implemented using a logic inverter gate with on-chip resistors and capacitors. Likewise, the other end of the tuning capacitor may be connected to the reset contact pad. Hence, by sharing a single contact pad or pin between the fine-tuning capacitor and the digital logic control circuitry (which is for the test and/or reset functions in the present example), an on-chip fine-tuning capacitor can be provided without additional contact pad overheads or without requiring substantial re-layout of the existing PCBs.

Figure 4:
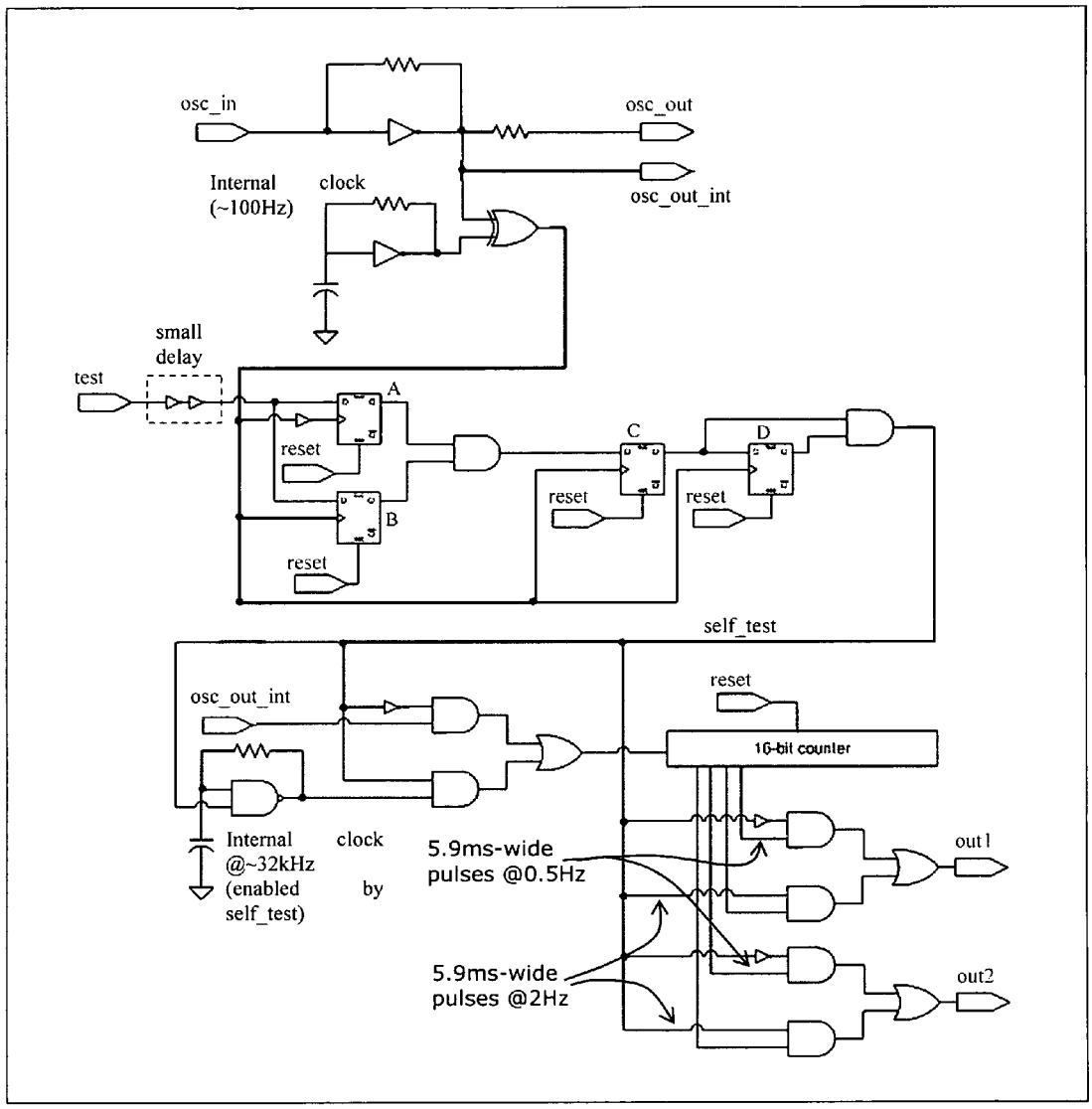
FIG. 4 is a more detailed schematic circuit diagram of the integrated circuit of FIG. 3.
Figure 5:
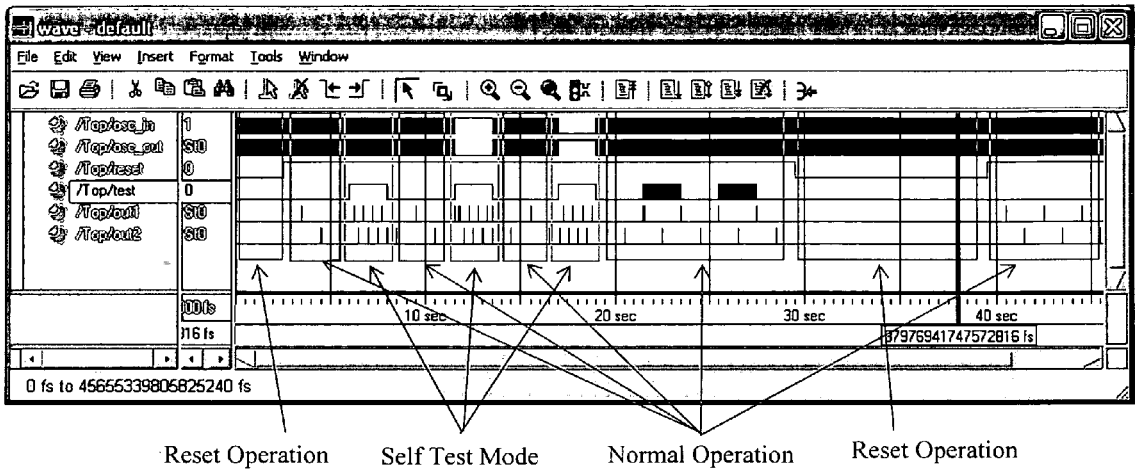
FIG. 5 shows exemplary timing diagrams illustrating aspect of operation of the integrated circuit of FIG. 3.

The exemplary logic circuit diagram of FIG. 4 shows an example of the internal logic of the testing the stepper motor and driver circuitry using conventional logic symbols. The timing diagram in FIG. 5 shows the relationship between the logic conditions of the test contact pad and the output pulses of the stepper motor driver circuit as a convenient illustration.

Figure 6:
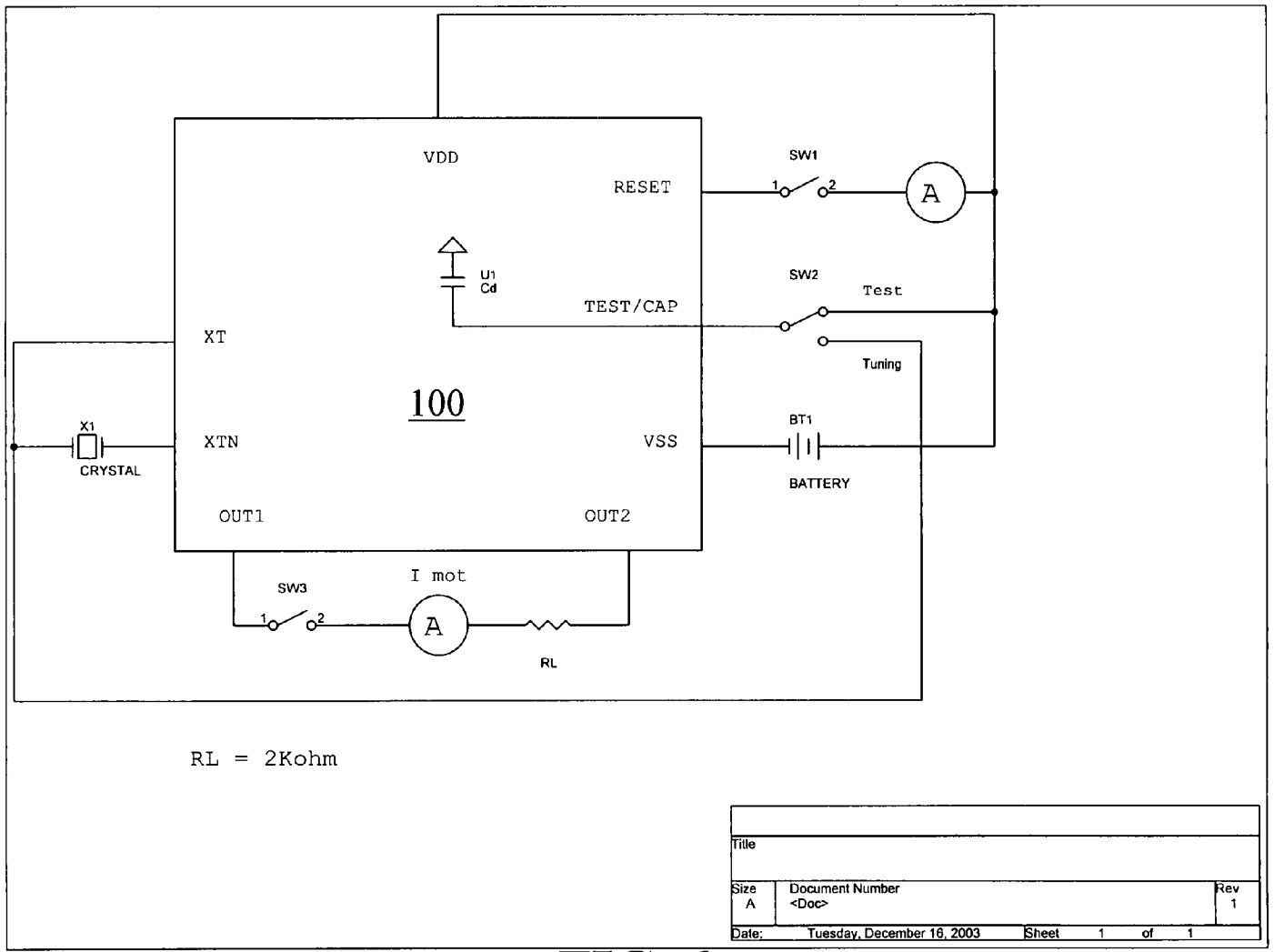
FIG. 6 is an exemplary application circuit of the integrated circuit of FIG. 3.

FIG. 6 shows an exemplary application circuitry of a preferred embodiment of the integrated circuit of the present invention. The integrated circuit is connected to a quartz crystal X1 and XTN. The stepper motor is connected to the stepper motor driver output contact pads OUT1 and OUT2 via a switch SW3. A battery which supplies operating electrical power to the integrated circuitry is connected to the contact pads marked Vss and Vdd. As shown in the Figure, the "TEST" and "CAP" connection, representing the test switch and the other terminal of the fine-tuning capacitor, shares a common contact pad. This common contact pad is connected via a two-way switch SW2 respectively and alternatively to the test circuit and the tuning circuit.

During stepper motor testing, the two-way switch is connected to the testing circuit configuration to cause output of pulses of a higher frequency from the stepper motor driving circuitry logic. After testing has been completed, the two-way switch will be optionally switched to connect with the other terminal of the fine-tuning capacitor should that be necessary or desirable.

In this exemplary circuitry, if the test/reset contact pad is open-circuited (floating) or is connected to the XT and XTN outputs, the IC will be under normal operation mode. One the other hand, if the test/rest pin is held at logic high or low, it means that the IC is under a testing or other functions.

Figure 7:
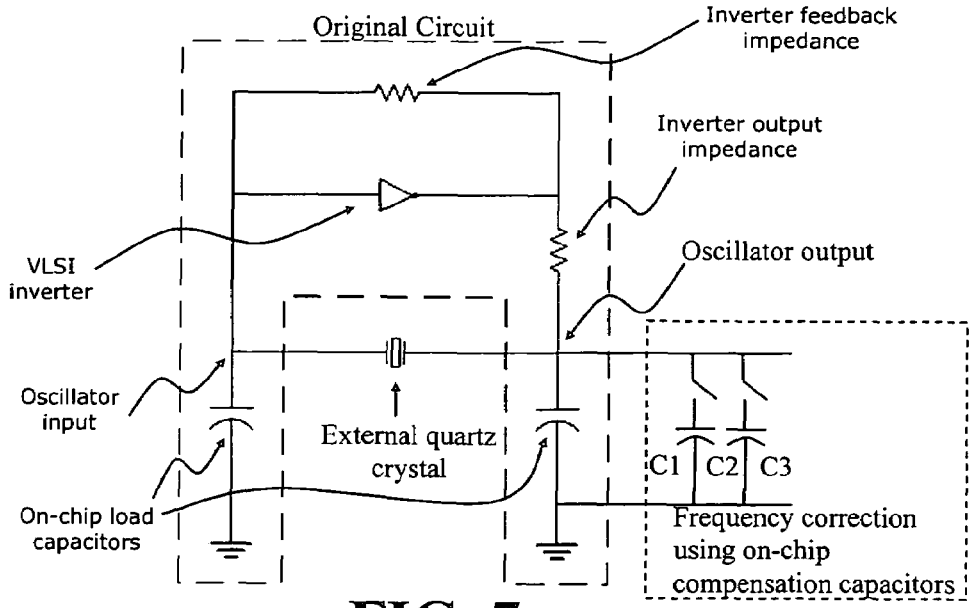
FIG. 7 is an equivalent schematic circuit diagram showing an oscillator circuit of a second preferred embodiment of this invention comprising a plurality of switchable trimming capacitors.
Figure 8:
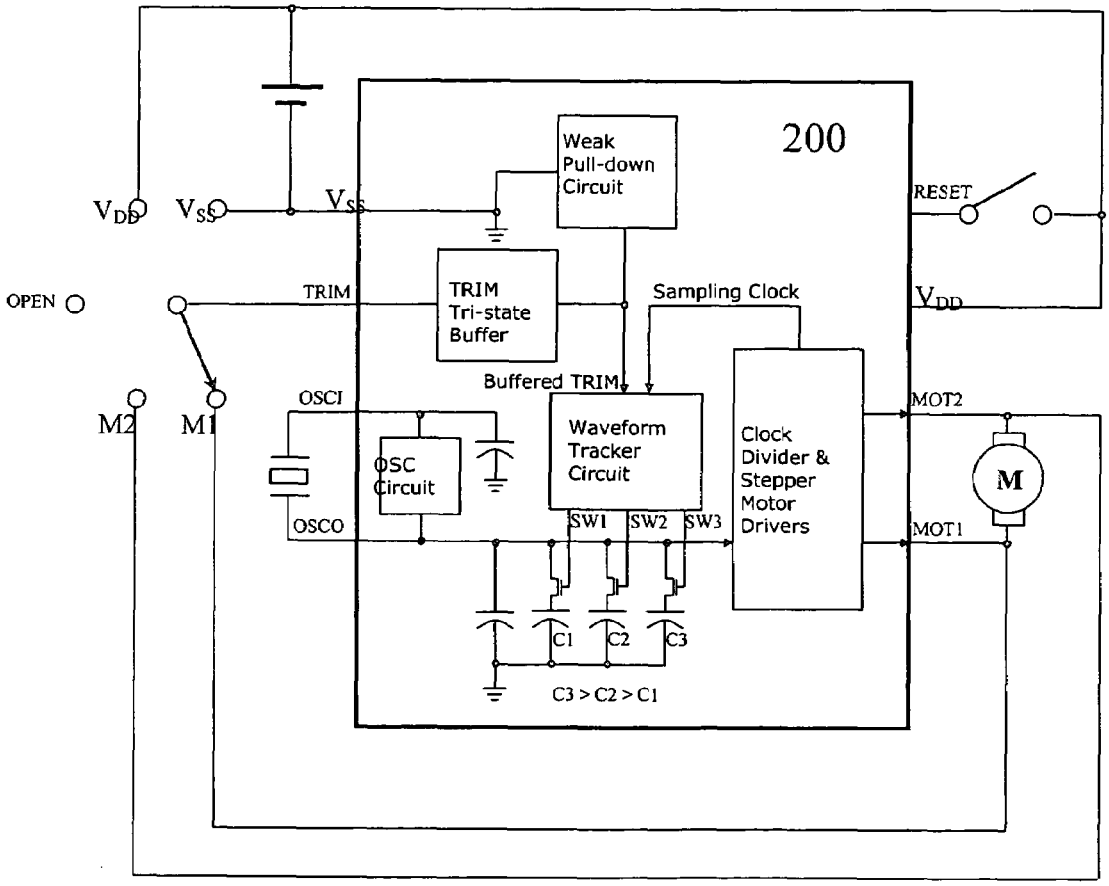
FIG. 8 is a schematic block diagram showing an IC of a second preferred embodiment of this invention and its application.

A second preferred embodiment of an integrated circuit 200 of this invention is shown in FIGS. 7 and 8. Similar to the integrated circuit 100 of FIG. 1, the integrated circuit 200 of this preferred embodiment comprises an oscillator circuit which generates a fundamental clock signal of, say, for example, 32.768 kHz, when connected with an appropriate quartz crystal and when connected to a supply power $V_{DD}$. The oscillator circuitry can be of the Pierce topology or other appropriate oscillator configuration known to persons skilled in the art without loss of generality.

A plurality of electronic switchable on-chip trimming capacitors, (C1, C2, C3), are provided on the integrated circuit. The on-chip capacitors (C1, C2, C3) can be switched in and/or out selectively in order to vary the load capacitance of the oscillator circuitry whereby the oscillator frequency can be fine-tuned to correct for frequency deviation due to, for example, manufacturing tolerances. The exemplary IC 200 is in a typical 8-in package which is the most widely used package for electronic watch ICs. In a typical 8-pin analogue watch IC, two pins are for power supply (VDD and VSS), two pins are for connecting to an external crystal (XT, XTN), two pins are for driving a stepper motor (M1, M2), one input pin is for reset function (RESET) and one input pin is for test function (TEST).

In a conventional IC, the test pin (TEST) is only responsible for self-test function. When TEST is connected to VDD, the analogue watch IC is in self-test mode. When TEST is open, the analogue watch IC is in normal mode.

In this preferred embodiment, the test pin (TEST) is replaced by a trim pin (TRIM) and its functions will be explained below. Specifically, the trim pin (TRIM) provides an interfacing means so that external instruction signals can be transmitted to the switching control circuitry to control the switching of the trimming capacitors. An exemplary operation logic is described below:

a. When TRIM is connected to VSS or is left open, the analogue watch IC runs at nominal frequency.

b. When TRIM is connected to M1, the analogue watch IC runs at, say 6 ppm, below nominal frequency. This is accomplished by connecting a small on-chip trimming capacitor (C1) to the load capacitance.

c. When TRIM is connected to M2, the analogue watch IC runs at, say 12 ppm, below nominal frequency. This is accomplished by connecting a small on-chip compensation capacitor (C2) to the load capacitance.

d. When TRIM is connected to VDD, the analogue watch IC runs at, say 18 ppm, below nominal frequency. This is accomplished by connecting a small on-chip compensation capacitor (C3) to the load capacitance.

Figure 9:
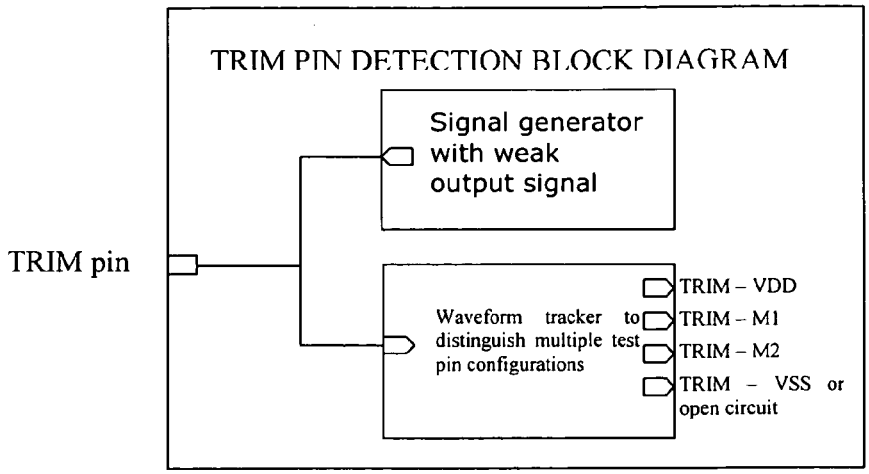
FIG. 9 is a block logic diagram showing detection circuitry for detecting an external switching state signal at pin TRIM of the IC of FIG. 8.

Naturally, the values of the trimming capacitors to achieve the prescribed frequency adjustment in ppm terms are known to persons skilled in the art. It will be appreciated a switching combination of the three individually switchable compensation (or trimming) capacitors can be configured to make eight ($2^3$) different frequency adjustments. However, only three alternative frequency adjustment configuration are explained in this embodiment since the decoding logic would be simpler. However, it will be appreciated that any number of alternative frequency adjustments up to the maximum is possible by using appropriate logic which are well known in the art. Since the TRIM pin/pad is the only interfacing connection port through which a fine-tuning switching signal is sent to the IC 200, the trim pin detection circuitry needs to reliably distinguish the various fine-tuning configurations without incurring significant power consumption. As shown in more detail in FIG. 9, the detection circuitry consists of two main components: a weak signal generator and a waveform tracker.

The weak signal generator is used to inject some background or weak signal to the TRIM pin when the TRIM pin is open (or floating). The output of this generator is sufficiently weak so that if the TRIM pin is connected to any other pin, this waveform does not affect the operation of the other pin.

An exemplary switching control signal discriminator is in the form of a waveform tracker circuit. The waveform tracker is used to monitor the TRIM pin to determine whether the TEST pin is connected to say, VDD, VSS, M1 or M2, so that the switching states of the trimming capacitors can be determined. Of course, it is relatively easy to distinguish between power (VDD) and ground (VSS) because of the voltage spread. On the other hand, it will require some time (e.g. 2 seconds) to distinguish between other waveforms (e.g. M1, M2, etc.) since the signals have the same or similar voltage level but with different timing characteristics. Typically, the waveform tracker receives the same internal clock as the other signals (e.g. M1, M2). As such, a state machine with synchronous clock can be used to quickly discern the various switching signal waveforms.

In order to minimize power dissipation, the test pin detection circuitry will be activated only during power up (or right after reset). After a short time, e.g., a couple of seconds, it can be automatically cut off from the TRIM pin using high impedance tri-state buffers to save power. Thus, this circuitry does not consume significant power during normal operation, regardless whether the TRIM pin is connected to VDD, VSS, M1 or M2.

Figures 11, 12:
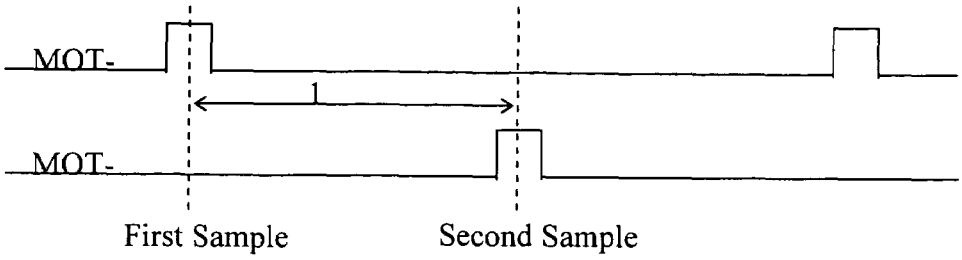
FIG. 11 is a timing diagram showing exemplary pulses at pins MOT-1 and MOT-2.
FIG. 12 is a table showing the various logic outputs for controlling the switching states of the trimming capacitors.

The TRIM pin detection circuit will be explained in further detail below. Referring to FIGS. 8, 11 and 12, the TRIM pin detection circuit comprises five major sub-blocks, namely, a) waveform tracker circuit, b) TRIM tri-state buffer, c) weak pull-down circuit, d) oscillator circuit and e) clock divider and stepper motor driver. Their functions are explained below.

a). Waveform Tracker Circuit

At power-up this circuit takes two digital samples of the TRIM pin and store these them in registers. The timing of these samples is shown below. The first sample is taken when MOT-1 is high and the second is taken when MOT-2 is high.

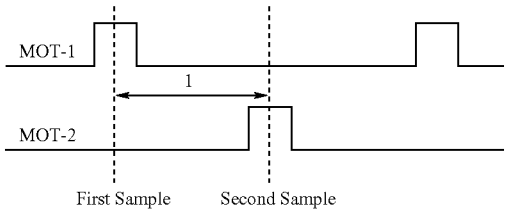

Based on these two sample values, we can distinguish among the four different TRIM configurations.

| 1st Sample | 2nd Sample | TRIM Configuration | Freq Compensation |
|---|---|---|---|
| Low | Low | TRIM - VSS/Open | Nominal Frequency |
| High | Low | TRIM - MOT-1 | −6 ppm |
| Low | High | TRIM - MOT-2 | −12 ppm |
| High | High | TRIM - VDD | −18 ppm |

When TRIM is left open or is connected to VSS, all compensation capacitors are turned off (SW1=off, SW2=off, SW3=off).

When TRIM is connected to MOT-1, a small compensation capacitor C1 is added to the load capacitance, reducing the oscillator frequency by 6 ppm (SW1=on, SW2=off, SW3=off).

When TRIM is connected to MOT-2, a small compensation capacitor C2 is added to the load capacitance, reducing the oscillator frequency by 12 ppm (SW1=off, SW2=on, SW3=off).

When TRIM is connected to VDD, a small compensation capacitor C3 is added to the load capacitance, reducing the oscillator frequency by 18 ppm (SW1=off, SW2=off, SW3=on).

b). TRIM Tri-State Buffer

The trim detection circuit is only needed at power-up and not during normal operation. To minimize power consumption, a TRIM tri-state buffer is added to isolate the internal circuit from the TRIM pin in normal mode.

Without this tri-state buffer, the internal pull-down circuit can dissipate substantial amount of power if the TRIM pin is connected to VDD, MOT-1 or MOT-2.

c). Weak Pull-Down Circuit

The weak pull-down circuit is designed such that if the TRIM pin is open, the TRIM signal level will remain at ground (VSS).

Should the TRIM pin be connected to VDD, MOT-1 or MOT-2, this weak pull-down circuit does not significantly affect the voltage level at the other pins.

d). Oscillator Circuit

The oscillator circuit consists of a logic inverter with a built-in voltage regulator. As described in the "Summary of Invention," the oscillation frequency decreases if the load capacitance increases (with additional compensation capacitors).

e). Clock Divider and Stepper Motor Driver

The oscillator frequency runs at approximately 32.768 kHz. A binary counter is used to divide this clock down to 0.5 Hz stepper motor drive outputs.

This circuit is also responsible for generating a sampling clock that is used in the waveform tracker mentioned earlier.

Figure 10:
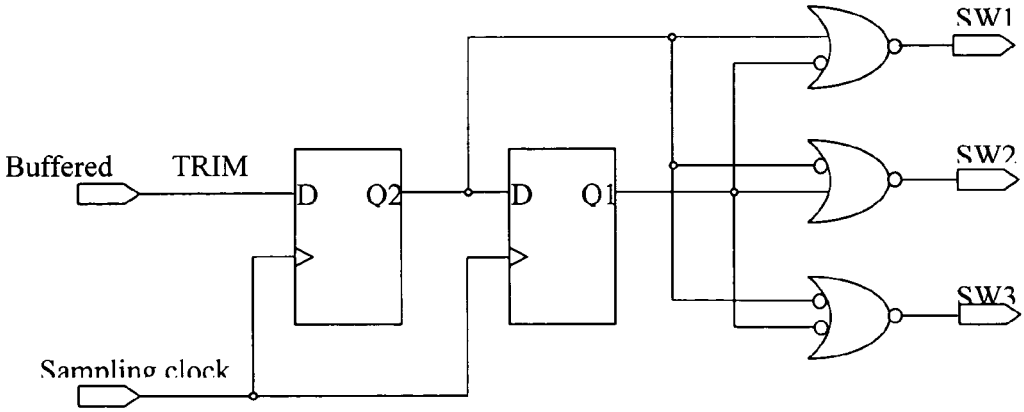
FIG. 10 is a logic circuit diagram showing an exemplary tracker circuit.

An exemplary waveform tracker logic diagram is shown in FIG. 10. Referring to FIG. 10, it will be observed that:

If TRIM is connected to VSS or is open, Q1=0 and Q2=0.
SW1=SW2=SW3=0 (off).
Oscillator runs at nominal Frequency.

If TRIM is connected to MOT-1, Q1=1 and Q2=0.
SW1=1 (on) and SW2=SW3=0 (off).
Oscillator runs at −6 ppm.

If TRIM is connected to MOT-2, Q1=0 and Q2=1.
SW2=1 (on) and SW1=SW3=0 (off).
Oscillator runs at −12 ppm.

If TRIM is connected to VDD, Q1=1 and Q2=1.
SW3=1 (on) and SW1=SW2=0 (off).
Oscillator runs at −18 ppm.

Thus, this preferred embodiment has illustrated an exemplary circuitry and operation of a plurality switches to connect/disconnect a corresponding plurality of capacitors with/from the oscillator circuit so as to fine-tune and/or adjust oscillation frequency. Although a single trimming capacitor is connected at a time, it will be appreciated that a selective combination of the trimming capacitors can be connected by varying the switching signal without loss of generality.

While the present invention has been explained by reference to the preferred embodiments described above, it will be appreciated that the embodiments are illustrated as examples to assist understanding of the present invention and are not meant to be restrictive on the scope and spirit of the present invention. The scope of this invention should be determined from the general principles and spirit of the invention as described above. In particular, variations or modifications which are obvious or trivial to persons skilled in the art, as well as improvements made on the basis of the present invention, should be considered as falling within the scope and boundary of the present invention.

Furthermore, while the present invention has been explained by reference to various parameters such as characteristic quartz or stepper motor testing frequencies, it will of course be appreciated such parameters are only for convenient examples without loss of generality.

The invention claimed is:

1. An integrated circuit for analog electronic watch applications, comprising an oscillator circuit for generating clock signals, a stepper motor driver circuit for generating motor driving signals, a plurality of trimming capacitors for fine-tuning the output frequency of the oscillator circuit and a corresponding plurality of electronic switches for selectively connecting/disconnecting said trimming capacitors to said oscillator circuit and switching circuitry for switching-in and/or -out the electronic switch, wherein said stepper motor driver circuit is connected to said oscillator circuit and comprises means for converting said clock signals into said motor driving signals, said switching circuitry comprises means to control the switching-in and/or switching-out of said electronic switches whereby oscillator frequency is fine-tuned, and said plurality of electronic switches are selectively controllable and operable by switching control signals applied at a frequency trimming port.

2. An integrated circuit according to claim 1, wherein said switching circuitry comprises a switching control signal discriminator which detects and discerns the switching control signals at said frequency trimming port and said switching control signal discriminator causes said switching circuitry to selectively operate said plurality of electronic switches according to the individual characteristics of said switching control signals whereby the oscillation frequency of said oscillator can be varied by one of a plurality of discrete steps.

3. An integrated circuit according to claim 2, wherein each trimming capacitor and each electronic switch is connected in series, with each serial combination of a trimming capacitor and an electronic switch being in parallel to the connection of a quartz crystal during operation.

4. An integrated circuit according to claim 2, wherein said switching circuitry comprises a tri-state switch, said integrated circuit comprises three electronic switches and three trimming capacitors, and the switching control signals comprise said motor driving signals.

5. An integrated circuit according to claim 2, wherein operation of said plurality of electronic switches to connect and/or disconnect the trimming capacitors to the oscillator circuit is by a switching state signal sent via a single external connection pad on said integrated circuit.

6. An integrated circuit according to claim 5, wherein said control signals comprise pulses from said motor driving circuitry.

7. An integrated circuit of claim 2, wherein said oscillator circuitry has a characteristic frequency of 32.768 kHz, with the output frequency of the stepper motor driver during normal operation as an analog watch being 1 Hz.

8. An integrated circuit of claim 7, wherein said integrated circuit has a total of 8 externally accessible contact pads.

9. An integrated circuit of claim 2, wherein said switching control signal comprises one of the following alternatives, supply voltage to the integrated circuit, floating open of the frequency trimming port, tying of the frequency trimming port to the ground, the motor driving signals and/or a combination thereof.

10. An integrated circuit of claim 9, wherein said stepper motor driver circuit comprises two output ports for generating two streams of motor driving signals with different pulse timing, the switching control signal discriminator is adapted to receive and discern the two streams of motor driving signals whereby said plurality of electronic switches are operated to produce at least two frequency trimming capacitance according to which one of the streams is connected to the frequency trimming port.

11. An integrated circuit of claim 10, wherein the two streams of motor driving signals have the same pulse period and frequency but with different pulse rising timing.

12. An integrated circuit of claim 11, wherein said control signal discriminator comprises timing means to discriminate the two motor driving signals with reference to the timing relationship between the two motor driving signal streams.

13. An integrated circuit of claim 11, wherein the switching states of the plurality of electronic switches are established during starting-up of the integrated circuit, the switching control signal discriminator comprises means to ascertain whether the switching control signal is one of the two motor driving signals by referencing to the pulse-timing of the two motor driving signals.

14. An integrated circuit of claim 2, wherein pulse-timing of at least one of the motor driving signals is used to operate at least one of the plurality of the electronic switches, whereby the load capacitance of the oscillator circuit is varied.

15. An integrated circuit for analog electronic watch applications, comprising an oscillator circuit for generating clock signals, a stepper motor driver circuit for generating motor driving signals, a test circuit for testing a stepper motor, a reset circuit for stopping and starting said oscillator circuit, and one or two on-chip trimming capacitors, wherein said trimming capacitors are located in the external pads of said test and reset circuits, and the oscillator frequency can be adjusted by connecting either oscillator input or output pad with test pad, reset pad, or both.

* * * * *